US009915500B2

(12) United States Patent
Ralph

(10) Patent No.: US 9,915,500 B2
(45) Date of Patent: Mar. 13, 2018

(54) PORTABLE FIREARM CARRIER

(71) Applicant: Josh Ralph, Maple Grove, MN (US)

(72) Inventor: Josh Ralph, Maple Grove, MN (US)

( * ) Notice: Subject to any disclaimer, the term of this patent is extended or adjusted under 35 U.S.C. 154(b) by 0 days.

(21) Appl. No.: 14/958,092

(22) Filed: Dec. 3, 2015

(65) Prior Publication Data

US 2016/0161216 A1 Jun. 9, 2016

Related U.S. Application Data

(60) Provisional application No. 62/089,046, filed on Dec. 8, 2014.

(51) Int. Cl.

| | |
|---|---|
| ***F41C 33/02*** | (2006.01) |
| ***A45F 3/02*** | (2006.01) |
| ***F41C 33/04*** | (2006.01) |

(52) U.S. Cl.

CPC ..... *F41C 33/0209* (2013.01); *A45F 3/02* (2013.01); *F41C 33/046* (2013.01); *F41C 33/048* (2013.01); *A45F 2200/0591* (2013.01)

(58) Field of Classification Search

CPC ..... F41C 33/0209; F41C 33/001; A45F 3/02; A45F 220/0591

USPC ..... 224/587

See application file for complete search history.

(56) References Cited

U.S. PATENT DOCUMENTS

| | | | | |
|---|---|---|---|---|
| 4,475,247 | A | 10/1984 | Lee | |
| 4,966,320 | A * | 10/1990 | DeSantis | A45C 1/04 224/192 |
| 5,294,031 | A | 3/1994 | Volpei et al. | |
| 5,431,318 | A | 7/1995 | Garcia | |
| 5,797,140 | A | 8/1998 | Davis | |
| 5,829,653 | A * | 11/1998 | Kaiser | A45F 4/02 2/2.5 |
| 7,337,508 | B2 | 3/2008 | Takasawa et al. | |
| 2009/0049658 | A1 | 2/2009 | Takasawa et al. | |
| 2012/0011684 | A1 | 1/2012 | Takasawa et al. | |
| 2012/0152995 | A1* | 6/2012 | Wilson | A45F 3/005 224/587 |
| 2013/0291350 | A1* | 11/2013 | Cowin | A44B 19/32 24/427 |
| 2016/0010948 | A1* | 1/2016 | Gerdes | A45C 3/06 150/117 |
| 2016/0076852 | A1* | 3/2016 | Liu | F41C 33/0209 224/587 |

FOREIGN PATENT DOCUMENTS

| | | |
|---|---|---|
| EP | 1 468 622 B1 | 11/2008 |
| WO | WO 01/71270 A1 | 9/2001 |

* cited by examiner

*Primary Examiner* — Corey Skurdal
(74) *Attorney, Agent, or Firm* — Merchant & Gould P.C.

(57) ABSTRACT

The present disclosure relates to a portable firearm carrier including a bag having an interior compartment and a burst zipper for accessing the interior compartment. The portable firearm carrier also includes a handgun holster mounted within the interior compartment of the bag. The handgun holster is arranged and configured to retain a handgun at a position where the handgun can be accessed through the burst zipper.

25 Claims, 10 Drawing Sheets

PORTABLE FIREARM CARRIER

CROSS REFERENCE TO RELATED APPLICATION

This application claims the benefit of provisional application Ser. No. 62/089,046, filed Dec. 8, 2014, which is incorporated herein by reference in its entirety.

TECHNICAL FIELD

The present disclosure relates generally to devices for carrying and concealing firearms.

BACKGROUND

Personal protection is an ever increasing concern. Many individuals rely on firearms to provide personal protection. The ability to effectively use a firearm to provide personal protection is typically dependent upon a number of factors including: 1) the ability to effectively and conveniently conceal the firearm; and 2) the ability to rapidly access the concealed firearm in response to a threat. Improvements are needed in this area.

SUMMARY

Aspects of the present disclosure relate to a portable firearm carrier that allows a handgun to be effectively concealed without being dependent upon the type of clothing the carrier is wearing, and that concurrently allows the handgun to be readily accessed in response to a threat. For example, certain aspects of the present disclosure relate to a portable firearm carrier that allows a handgun to be concealed and carried without requiring the carrier to wear bulky clothing such as a jacket or a like garment.

Another aspect of the present disclosure relates to a portable firearm carrier that uses a carrier bag arrangement configured to: a) effectively conceal and carry the firearm; and 2) allow the handgun to be easily accessed using a rapid motion comparable to the motion used to access a handgun from a traditional hip mounted or shoulder mounted holster. In certain examples, the present disclosure relates to a portable firearm carrier including a bag that contains a holster and that includes a burst zipper for rapidly accessing a handgun within the holster. In certain examples, the bag can include a shoulder strap that allows the bag to be worn on the person's back during normal situations, and also allows the bag to be moved to the person's front when the person's safety is threatened. With the bag positioned at the person's front, the handgun can be quickly accessed using a motion that replicates or is similar to the motion used to withdraw a weapon from a traditional hip mounted or shoulder mounted holster.

A further aspect of the present disclosure relates to a portable firearm carrier that includes a bag having an interior compartment. The bag also includes a burst zipper for accessing the interior compartment of the bag. The portable firearm carrier further includes a handgun holster positioned within the interior of the bag. The handgun holster is arranged and configured to retain a handgun at a position where the handgun can be accessed through the burst zipper. In certain examples, the bag is a backpack. In certain other examples, the backpack includes a single shoulder strap that allows the backpack to be moved from a wearer's back to the wear's front. In certain examples, the handgun holster includes a trigger guard mounted holster. In still other examples, the handgun holster is mounted to a support substrate secured within the bag. In certain examples, the support substrate includes a plate. In certain examples, the support substrate can have a construction that allows the support substrate to function as body armor. In certain examples, the body armor can provide a ballistic protection level at least capable of stopping a round from a normal handgun.

Aspects of the present disclosure also relate to a method for carrying and concealing a portable firearm such as a handgun. In certain examples, the handgun is carried and concealed within a bag having a burst zipper. The bag can be carried on the person's back with a shoulder strap positioned over the person's shoulder. The bag can be moved from the person's back to a position in front of the person's chest or abdominal region in a motion which causes the shoulder strap to slide across the person's shoulder as the bag moves from the person's back to the position in front of the person's chest or abdominal region. Typically, the bag is worn on the person's back during normal situations, and is moved to the person's front when a threat to the person's safety is encountered. Once the bag has been moved to a position in front of the person's chest or abdominal region, the bag can be opened through the use of a burst zipper to access the handgun. The motion for accessing the handgun can be comparable to a motion used to access a handgun from a conventional hip or shoulder mounted holster. Thus, the handgun can be comfortably and practically concealed during normal situations, and can also be rapidly accessed when a threat is encountered.

Aspects of the present disclosure further relate to a method for carrying and accessing a concealed handgun. The method includes inserting the handgun into a carrying bag through a burst zipper. The method also includes securing the handgun at a handgun mounting location within the carrying bag with the handgun held at an orientation with the grip of the handgun positioned adjacent to a burst location of the burst zipper. The method further includes closing the burst zipper after the handgun has been secured at the handgun mounting location. The method further includes carrying the handgun with the handgun secured therein. The method additionally includes accessing the handgun by bursting the burst zipper at the burst location, grasping the grip of the handgun through the burst zipper and withdrawing the handgun from the handgun mounting location and the bag.

A variety of additional inventive aspects will be set forth in the description that follows. Inventive aspects can relate to individual features and to combinations of features. It is to be understood that both the forgoing description and the following detailed description are exemplary and explanatory only and are not restrictive of the broad inventive concepts upon which the examples disclosed herein are based.

DETAILED DESCRIPTION

Figure 1:
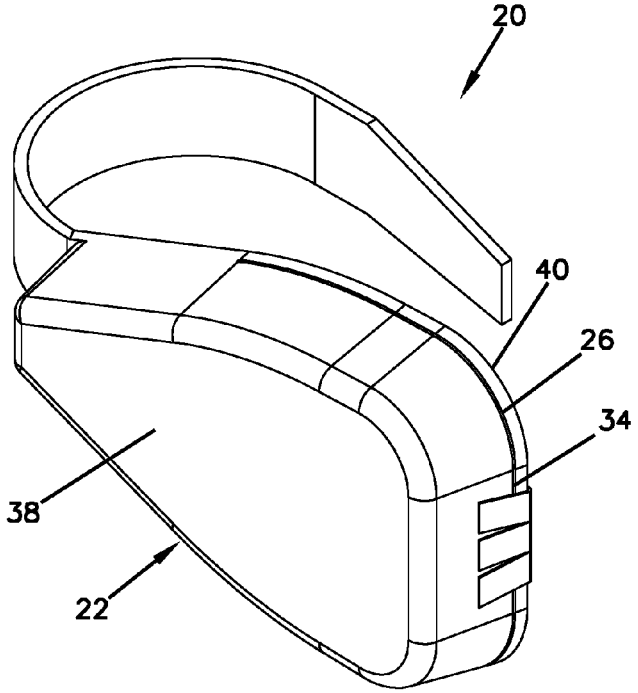
FIG. 1 is a perspective view of an outwardly facing side of a portable firearm carrier in accordance with the principles of the present disclosure.

Aspects of the present disclosure relate to a portable firearm carrier that allows a firearm such as a handgun to be readily concealed, carried and accessed without requiring the carrier to wear a particular type of clothing to provide the concealment. In certain examples, the portable firearm carrier includes a bag that provides effective concealment of the handgun. In certain examples, a handgun holster is mounted within the bag so as to hold the handgun at a predetermined position within the bag that can be easily accessed from outside the bag. In certain examples, the bag includes an access location that can be quickly opened to provide access to the handgun within the bag. In certain examples, the access location includes a burst zipper. In certain examples, the handgun can be accessed from within the bag using a motion similar to a motion used to withdraw a handgun from a transitional shoulder or hip mounted holster.

FIGS. 1-5 illustrate a portable firearm carrier 20 in accordance with the principles of the present disclosure. The portable firearm carrier 20 includes a bag 22 defining an interior compartment 24. The bag 22 also includes a burst zipper 26 for accessing the interior compartment 24 of the bag 22. The portable firearm carrier 20 further includes a handgun holster 28 mounted within the interior compartment 24 of the bag 22. The handgun holster 28 is arranged and configured to retain a handgun 30 at a predetermined position and orientation with a back side 31 of a grip 32 of the handgun 30 facing toward the burst zipper 26. In certain examples, the back side 31 of the grip 32 opposes a burst location 34 of the burst zipper 26.

Figure 3:
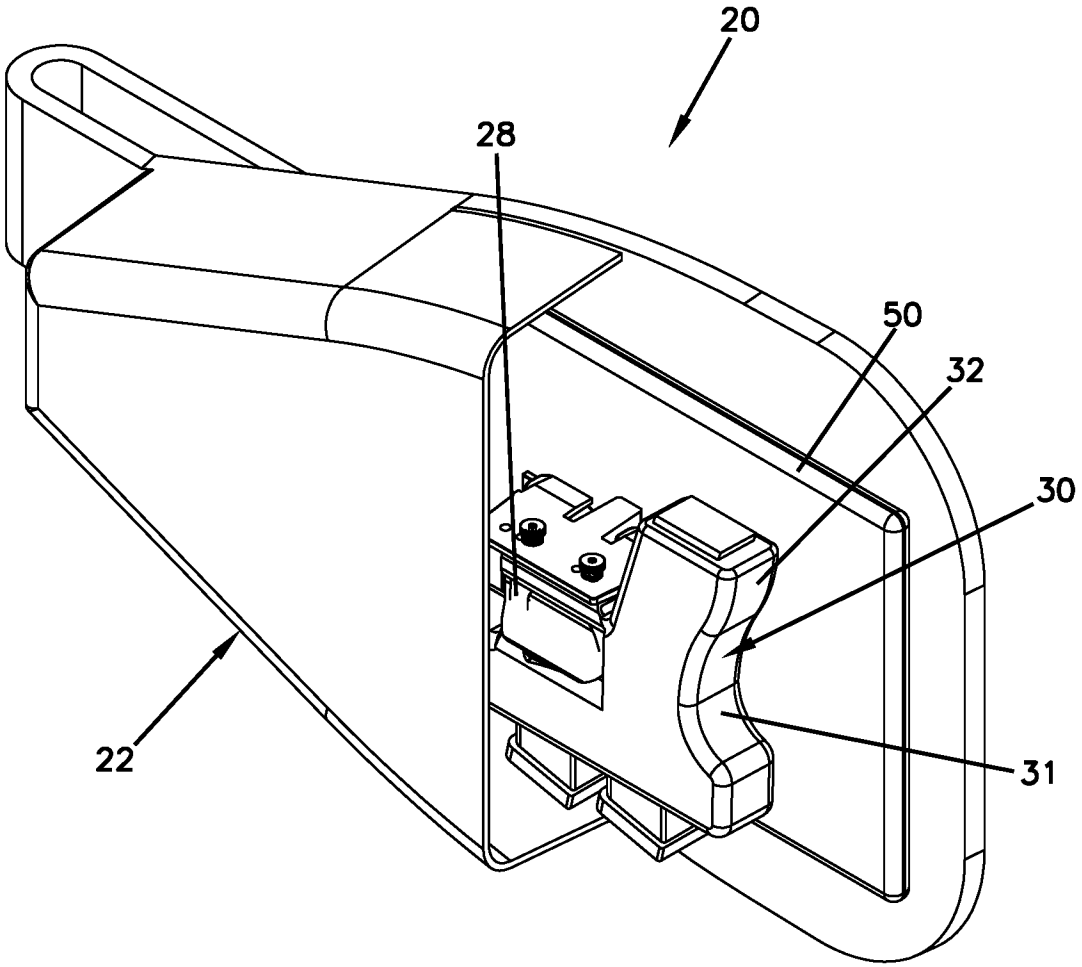
FIG. 3 is a perspective view of the portable firearm carrier of FIGS. 1 and 2 with a portion broken away to show an internal holster securing a handgun within a bag of the firearm carrier.

In certain examples, the bag 22 can be a backpack having one or more shoulder straps. As depicted, the bag 22 is shown as a backpack having a single shoulder strap 36. Referring to FIG. 3, the bag is depicted with the interior compartment 24 being the only compartment of the bag 22. In other examples, the interior compartment 24 can be one of a plurality of compartments. In certain examples, the other compartments can be used to hold personal items and can be enclosed by other types of closure structures such as standard zippers, buttons, latches, hooks, clips or other structures. In certain examples, the interior compartment 24 is a main compartment and the other compartments are secondary compartments.

Figure 11:
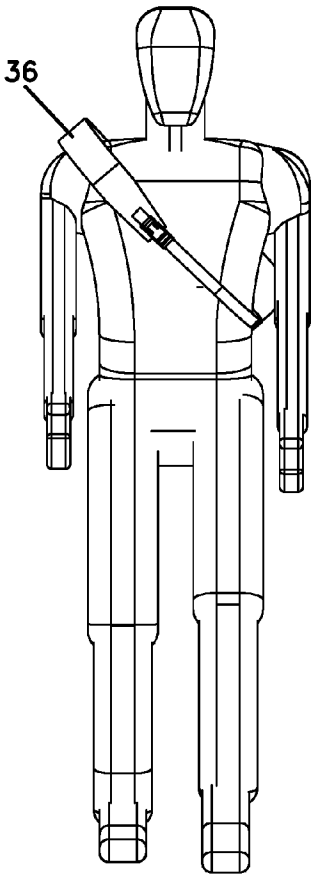
FIG. 11 is a front view showing the right-handed configured portable firearm carrier positioned at the person's back.
Figure 13:
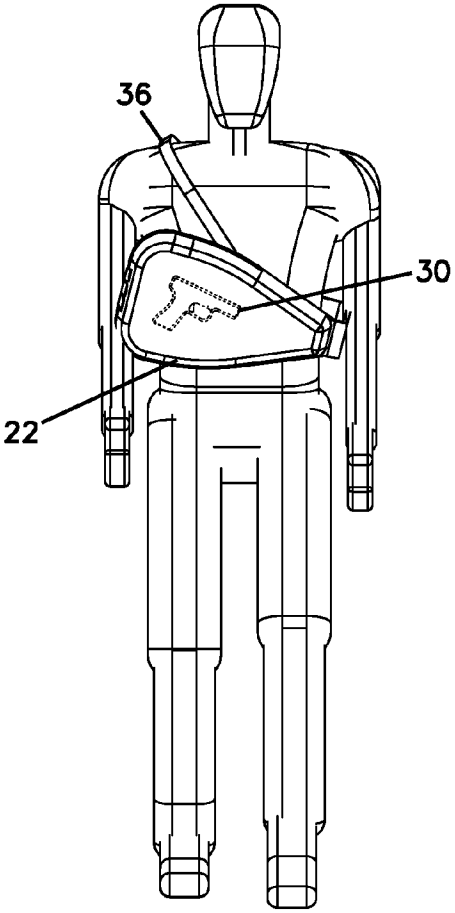
FIG. 13 is a front view showing the right-handed-configured portable firearm carrier worn by a right-handed person with the bag of the portable firearm carrier positioned in front of the person's chest and abdominal region.
Figure 12:
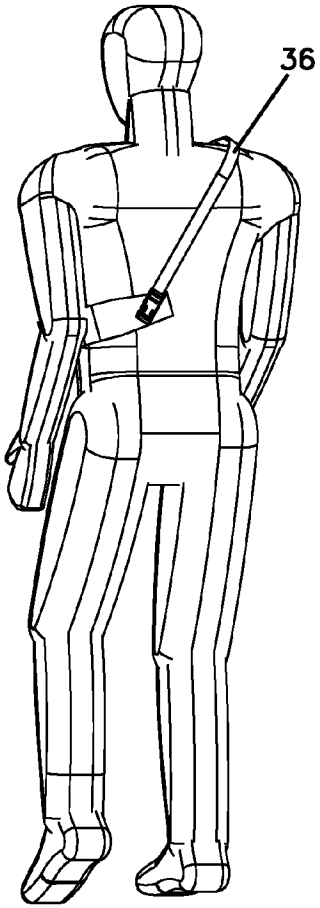
FIG. 12 is a rear view showing the right-handed-configured portable firearm carrier worn by a right-handed person with the bag of the portable firearm carrier positioned in front of the person's chest and abdominal region.
Figure 14:
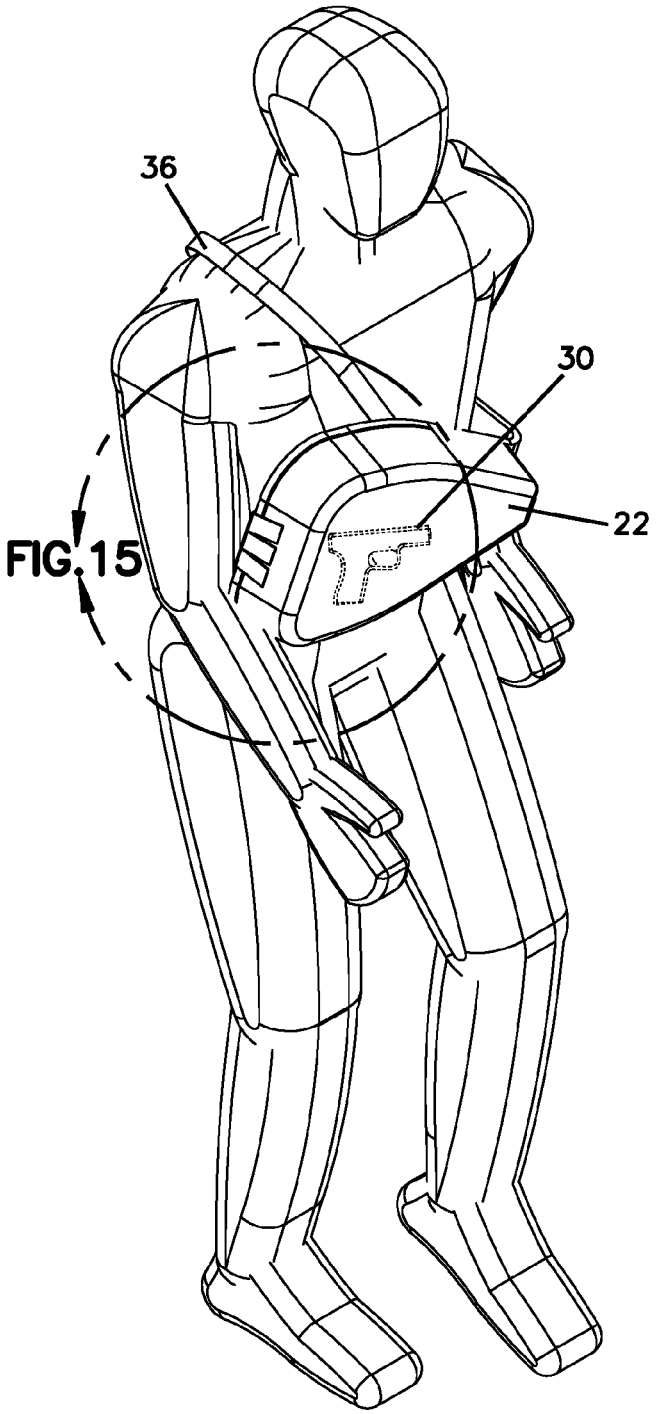
FIG. 14 is a another front view showing the right-handed-configured portable firearm carrier worn by a right-handed person with the bag of the portable firearm carrier positioned in front of the person's chest and abdominal region.
Figure 15:
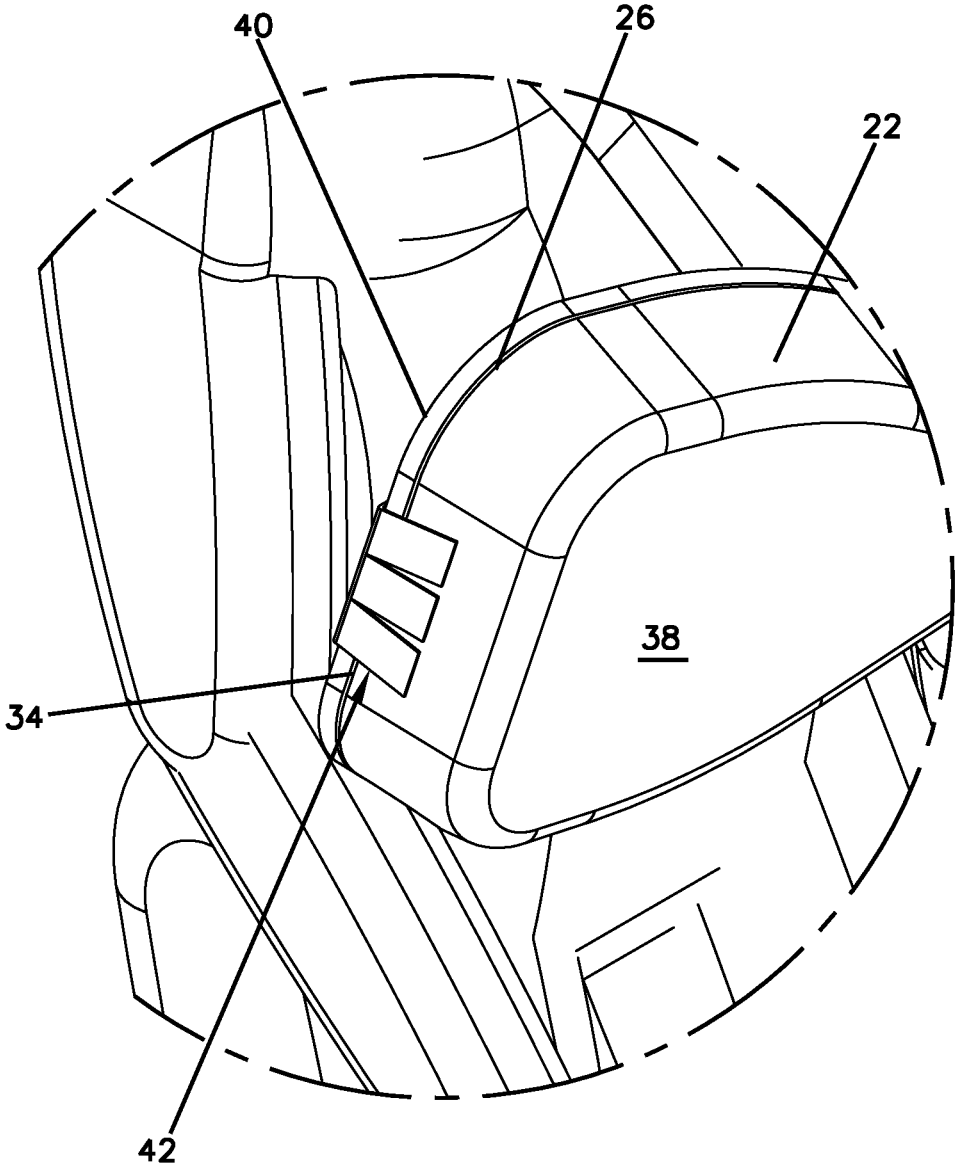
FIG. 15 is an enlarged view of a portion of FIG. 14.

The shoulder strap 36 of the portable firearm carrier 20 allows the bag 22 to be readily carried by a person as shown at FIGS. 10-14. As shown at FIGS. 10A, 10B and 11, the bag 22 is positioned at the person's back. As shown at FIGS. 12-15, the bag 22 is positioned in front of the person's chest and abdominal region. Normally, the person will carry the portable firearm carrier with the bag positioned to the person's back as shown at FIGS. 10A, 10B and 11. However, if the person anticipates a threat to their personal safety, the bag 22 can be moved from the person's back to the person's front (as shown at FIGS. 12-14) by sliding the shoulder strap 36 across the person's shoulder. With the bag 22 positioned at the person's front, the handgun 30 can be readily accessed through the burst location 34 of the burst zipper 26 of the bag 22. When the portable firearm carrier is worn with the bag at the person's front, the handgun 30 can be oriented within the bag 22 with a butt end of the grip of the handgun facing generally downwardly or at least partially downwardly. In this way, the handgun can be more easily withdrawn from the holster in a quick, fluid motion.

Figure 2:
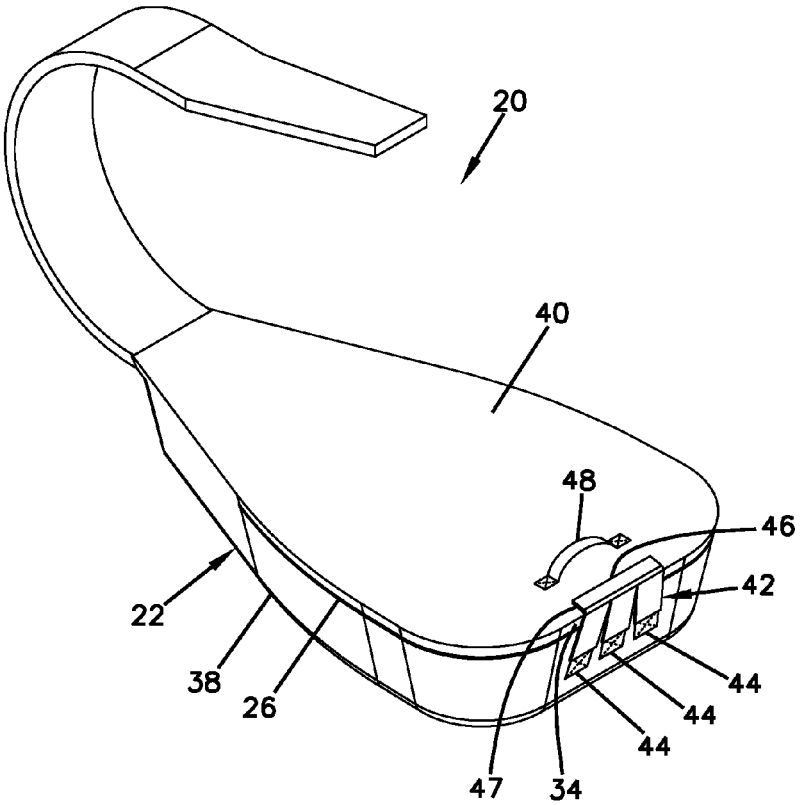
FIG. 2 is a perspective view showing an inwardly facing side of the portable firearm carrier of FIG. 1.

The bag 22 includes a first section 38 (e.g., a first portion, a first panel, a first side, etc.) that is adapted to face outwardly from the person's body when the portable firearm carrier 20 is worn by the person as shown at FIGS. 10-14. The bag 22 also includes a second section 40 (e.g., a second portion, a second side, a second panel, etc.) that is adapted to face toward the person's body when the portable firearm carrier 20 is worn as shown at FIGS. 10-15. The burst zipper 26 allows the first section 38 to be pulled away from the second section 40 to open the burst zipper 26 and provide access to the interior compartment 24. In certain examples, the burst zipper 26 is positioned generally between the first section 38 and the second section 40. In certain examples, handles such as straps or other structures can be provided for facilitating separating the first and second sections 38, 40 from one another thereby causing the burst location 34 of the burst zipper 36 to open. As depicted at FIG. 2, a handle structure 42 can extend across the burst location 34 of the burst zipper 26 to assist in keeping the burst zipper 26 closed until the handle structure 42 is pulled to open the burst location 34.

In certain examples, the handle structure 42 can be formed by one or more straps having base ends 44 anchored (e.g., stitched, adhesively affixed otherwise permanently retained) to the first section 38 of the bag 22 on a first side of the burst zipper 26. A free end 46 of the handle structure 42 can be temporarily attached to the second section 40 of the bag 22 at a second side of the burst zipper 26 by a temporary attachment technique such as a hook and loop fastener arrangement 47 (e.g., Velcro). In this way, handle structure 42 extends across the burst location 34 of the burst zipper 26 thereby concealing the burst location 34 and assisting in keeping the burst location 34 closed. By grabbing the free end 46 of the handle structure 42 and pulling outwardly away from the person's body, the free end 46 is disengaged from the hook and loop fastener arrangement and force is applied to the burst location 34 causing the burst location 34 of the burst zipper 26 to open such that the first section 38 pulls away from the second section 40 of the bag 22. In this way, the bag 22 opens to permit ready access to the handgun 30 retained within the handgun holster 28.

In certain examples, another handle structure 48 is provided on the second section 40 of the bag 22. To open the burst zipper 26, the person can use one hand to grasp the handle structure 48 and the other hand to pull on the handle structure 42. In this way, opposing forces can be utilized to readily open the burst zipper 26. It will be appreciated that the handles can include single straps, multiple straps, straps arranged in looped configurations, straps arranged in double loop strap configurations and other configurations.

Figure 4:
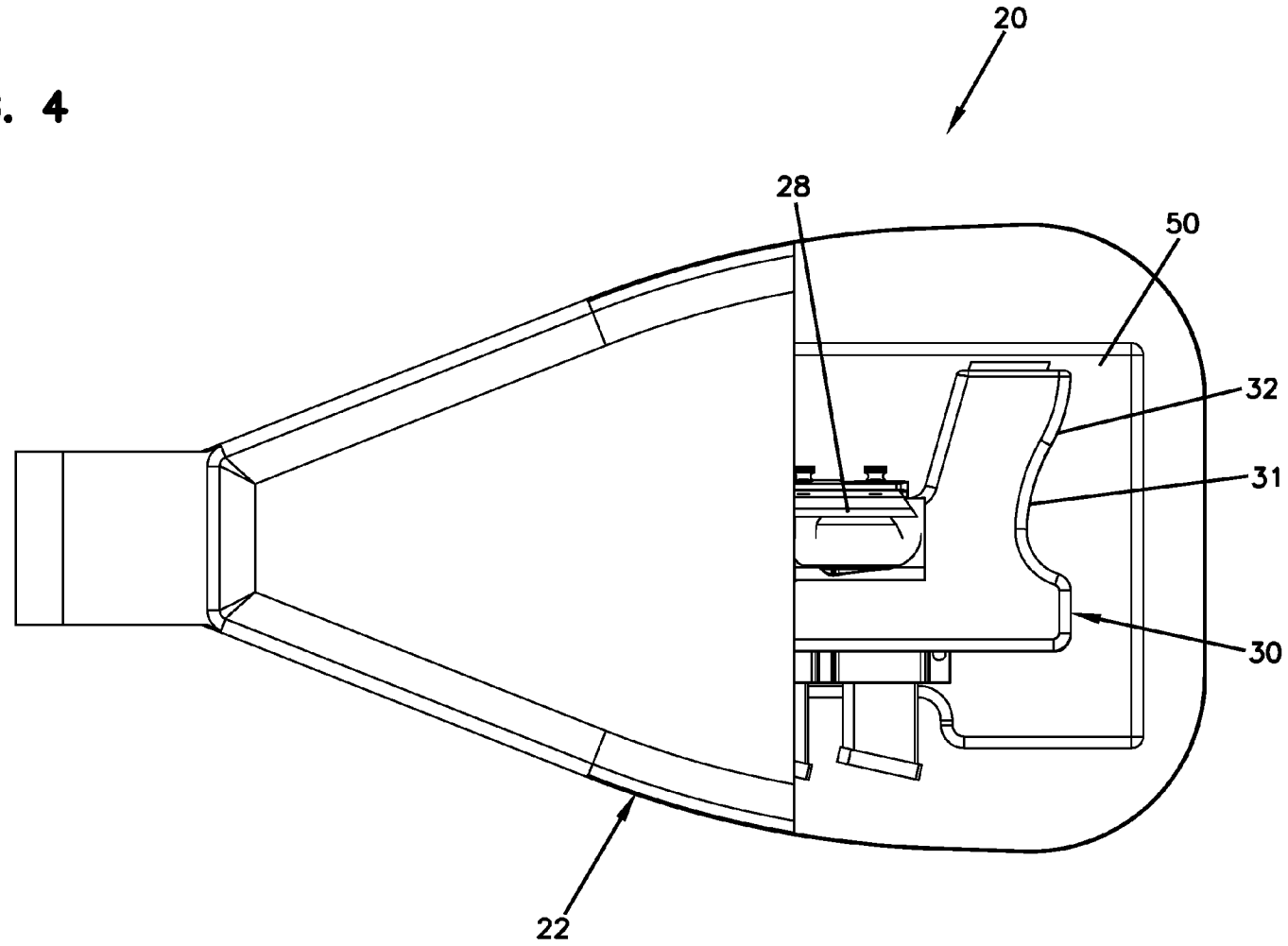
FIG. 4 is a plan view showing the portable firearm carrier of FIG. 3.
Figure 5:
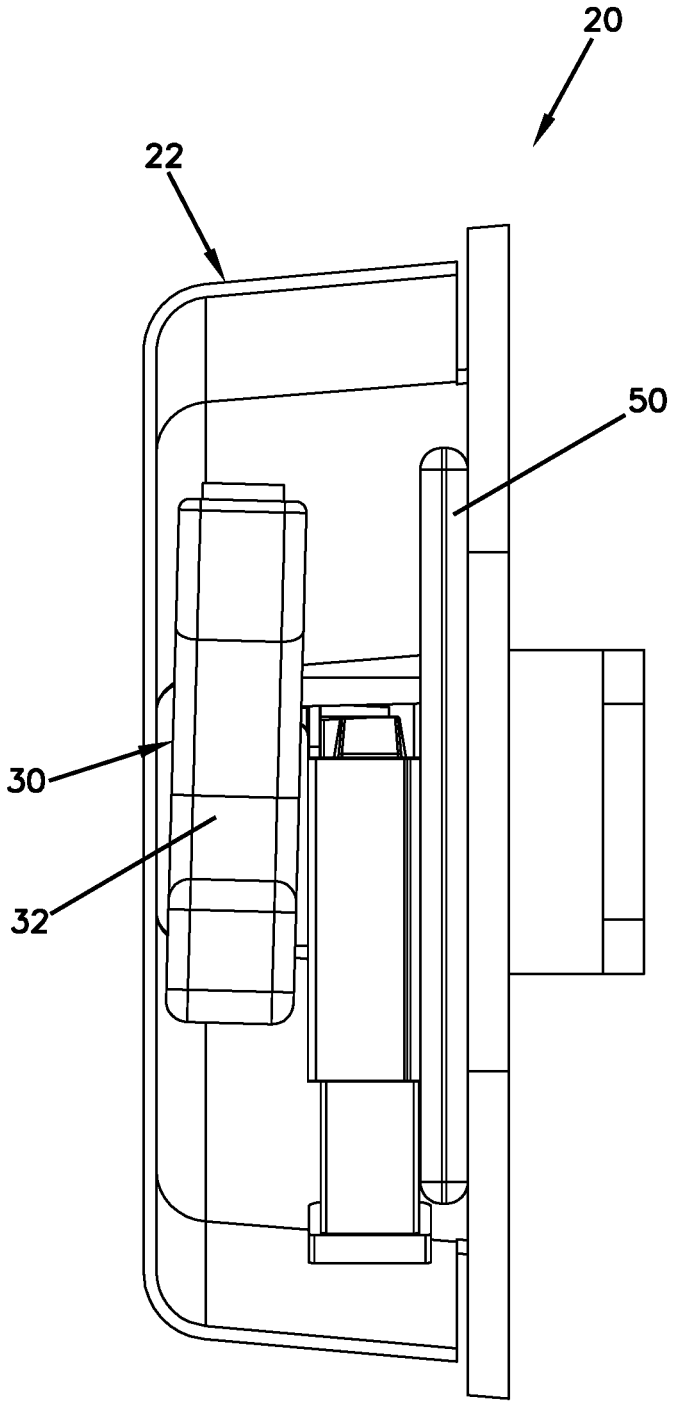
FIG. 5 is an end view of the portable firearm carrier of FIG. 4.
Figure 6:
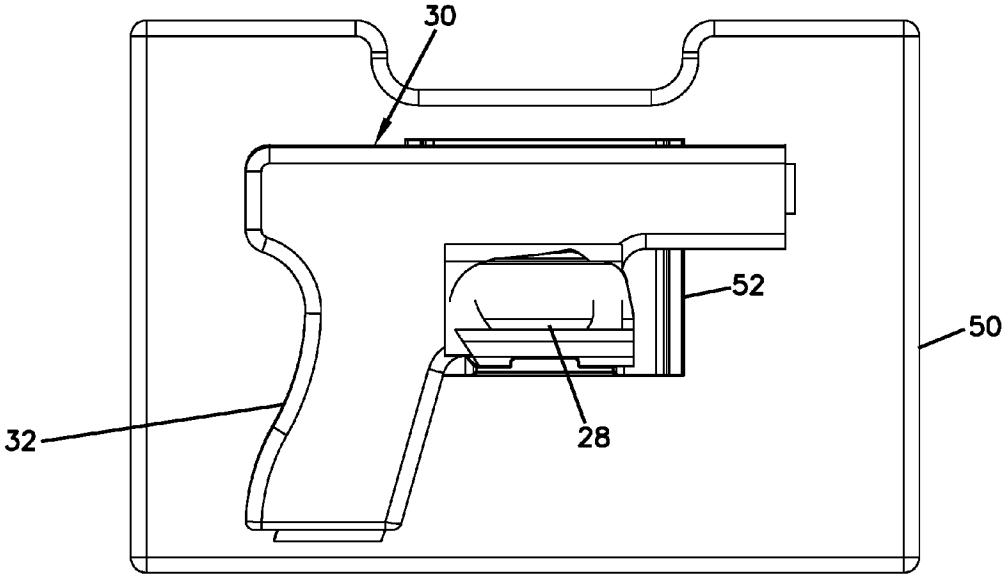
FIG. 6 is a plan view of an arrangement including the holster, handgun and a support substrate of the portable firearm carrier of FIGS. 1-5.
Figure 7:
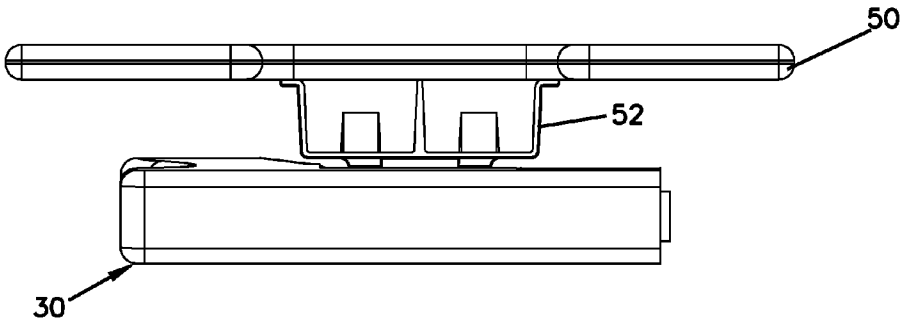
FIG. 7 is a top view of the arrangement of FIG. 6.
Figure 9:
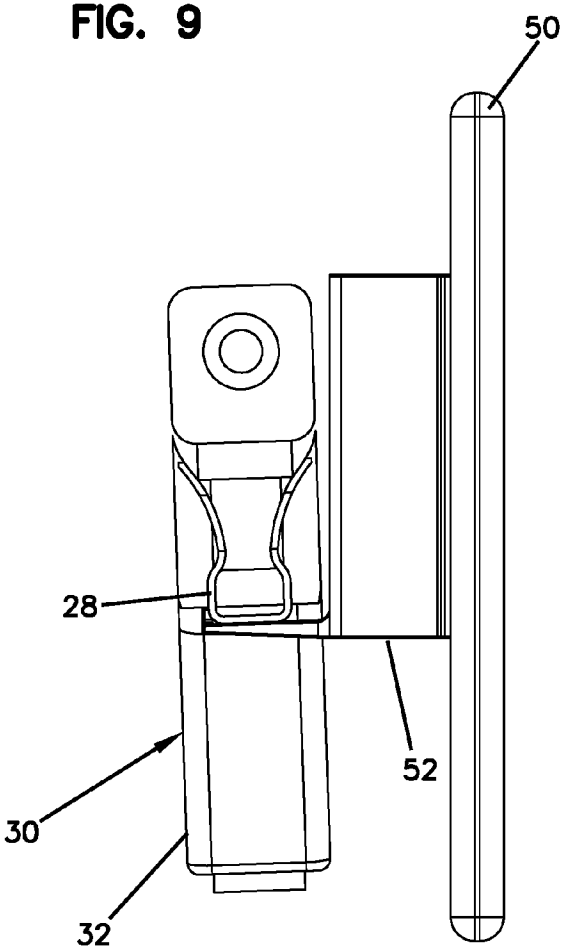
FIG. 9 is a barrel end view of the arrangement of FIG. 6.
Figure 8:
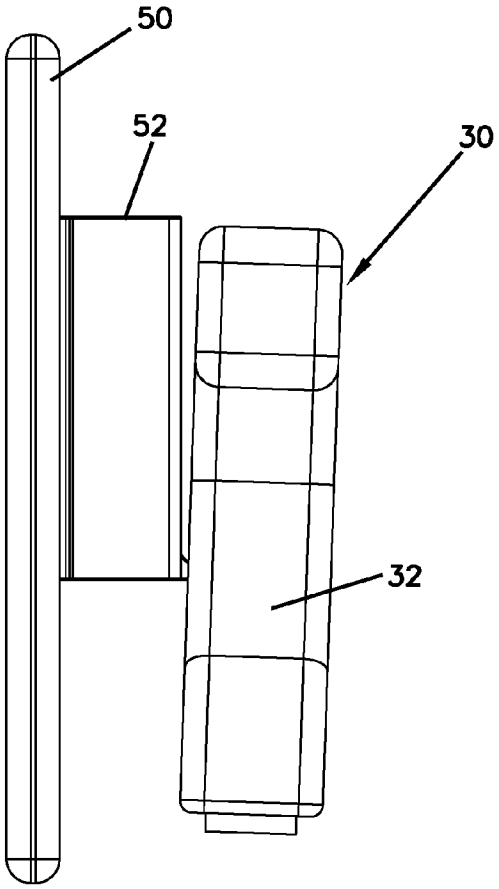
FIG. 8 is a grip end view of the arrangement of FIG. 6.

Referring to FIGS. 3-5, the handgun holster 28 can be mounted to a support substrate 50 positioned within the interior compartment 24 of the bag 22. The support substrate 50 preferably has a self-supporting construction and is made of a material that is more rigid than the material forming the bag 22. In certain examples, the substrate 50 can include a plate such as a plastic plate secured within the bag 22. The support substrate 50 can be secured within the bag 22 by fastening techniques such as hook and loop fasteners, adhesive, latches, straps, or other structures. In certain examples, the substrate 50 is mounted so as to be generally fixed within the bag 22. In certain examples, support substrate 50 can have a construction that provides ballistic protection for protecting the wearer's vital regions when the bag 22 is moved to the person's front abdominal/chest region. In certain examples, the support substrate 50 is made of a body-armor type material capable of stopping a round from at least a normal handgun. In certain examples, the substrate 50 can provide protection to at least ballistic protection threat level II as defined by the National Institute of Justice (NIJ).

Referring to FIGS. 6-9, the handgun holster 28 is mounted to the support substrate 50 through the use of a stand-off 52. The stand-off 52 is a bracket or other structure that offsets the holster 28 from a major side of the substrate 50. Preferably, the offset is sufficiently large to provide clearance for allowing the handgun grip 32 to be grasped while the handgun is secured by the handgun holster 28.

As used herein, a "holster" is a structure capable of securely holding a handgun at a position and preventing the handgun from being discharged while the handgun is secured by the holster. As depicted, the handgun holster 28 is a trigger-guard holster that mounts over the trigger guard of the handgun 30 thereby holding the handgun in place and preventing the trigger from being accessed. A trigger-guard holster is a holster that engages and covers the trigger-guard to secure the handgun in place and to prevent the trigger from being accessed. It will be appreciated that trigger-guard holsters can engage the gun by snapping, clipping or clamping onto the trigger-guard. In certain examples, a force of at least 5 pounds is required to withdraw the handgun from the trigger-guard holster. In other examples, other types of holsters can be used. For example, holsters having structures such as cradles that receive portions of the barrel of the handgun. Additionally, holsters having one or more retention latches or other retaining structures are also contemplated. In certain examples, holsters having retention levels of Retention Level I, Retention Level II, or Retention Level III are all contemplated.

As used herein, a "burst zipper" is a zipper having a burst location at an intermediate location along the length of the zipper. A burst location is a location where the zipper is weakened so that the zipper can be readily pulled apart by pulling laterally on opposite sides of the zipper. In certain examples, the teeth of the zipper can be modified at the burst location so that they can be more easily disengaged from one another as compared to standard zipper teeth. An example burst-zipper is disclosed in U.S. Pat. No. 7,337,508, which is hereby incorporated by reference. Other burst-zippers are disclosed in United States Patent Application Publication Nos. US 2009/0049658; US 2012/0011684; and US 2013/0291350, which are hereby incorporated by reference in their entireties.

It will be appreciated that the portable firearm carrier 20 can be readily used for carrying, concealing and accessing a handgun. In using the portable firearm carrier 20, the handgun 30 is inserted into the carrying bag 22 through the burst zipper 26. The handgun 30 is then secured at a handgun mounting location defined by the handgun holster 28. The handgun mounting location is positioned within the bag 22 and is configured such that the handgun 30 is held with the grip 32 of the handgun 30 positioned adjacent to the intermediate burst location 34 of the burst zipper 26. The burst zipper 26 is then closed by zipping the burst zipper after the handgun 30 has been secured at the handgun mounting location. The person can then carry the bag 22 with the handgun 30 secured therein. When the person encounters a threat, the handgun 30 can be accessed by bursting the zipper 26 at the burst location 34, grasping the grip 32 of the handgun 30 through the burst zipper 26 and withdrawing the handgun 30 from the handgun mounting location (e.g., the holster) and the bag 22.

In certain examples of the present disclosure, the bag 22 is normally carried on the person's back with the shoulder strap 26 positioned over the person's shoulder. In this configuration, the bag 22 can be conveniently carried while still allowing full use of the person's hands. Because the bag 22 provides concealment of the internal firearm, a jacket or other type of bulky clothing is not required to provide concealment of the firearm. When the person anticipates a threat to their safety, the person can move the bag 22 from the person's back to a position in front of the person (e.g., in front of the person's abdomen or chest region) in a motion that causes the shoulder strap to slide across the person's shoulder as the bag moves from the person's back to the person's front. Once the bag 22 is at the person's front, the support substrate 50 can provide protection for the person's vital areas. Additionally, the handgun 30 can be readily accessed by pulling open the burst zipper 26 at the burst location 34, grasping the grip 32 of the handgun 30, and pulling the handgun from the handgun holster 28 and the interior of the bag 22. The positioning of the burst zipper 26 and the handgun holster 28 relative to the person's body are such that the handgun 30 can be accessed using a motion similar to a motion used to withdraw a handgun from a standard hip mounted or shoulder mounted holster. Thus, the configuration of the portable firearm carrier 20 provides effective concealment of the handgun 30 while also allowing the handgun 30 to be quickly accessed in emergency situations.

In the depicted embodiment of FIGS. 3-9, 10A and 11-15, the portable firearm carrier 20 is designed to be used by a right-handed person with the shoulder strap 36 positioned over the person's right shoulder. To move the bag 22 from the person's back to the person's front, the bag is moved between the person's left arm and the person's body as the bag moves from the person's back to the person's front. Concurrently, the shoulder strap slides across the person's right shoulder. With the bag positioned at the person's front, the burst location 34 of the burst zipper 26 faces toward the right side of the person's body so that the handgun 30 can be readily accessed from the handgun holster 28 by the person's right hand.

Figure 10B:
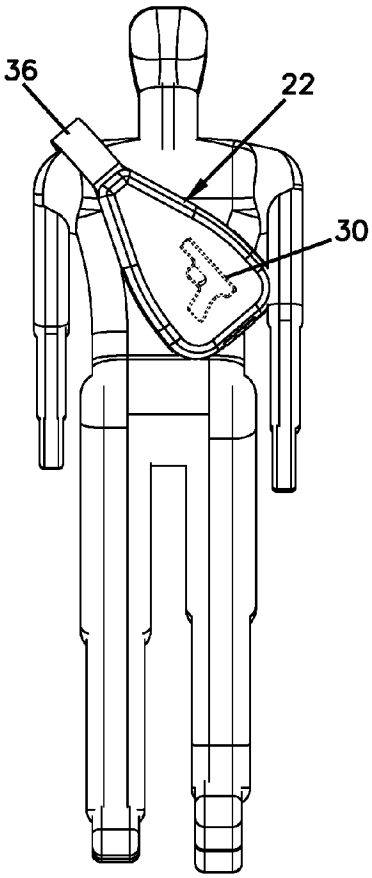
FIG. 10B is a back view showing the portable firearm carrier being worn by a left-handed person with the bag of the portable firearm carrier positioned at the person's back, the handgun is mounted within the bag at an orientation suitable to enhance left-handed access when the bag is moved to the person's front.
Figure 10A:
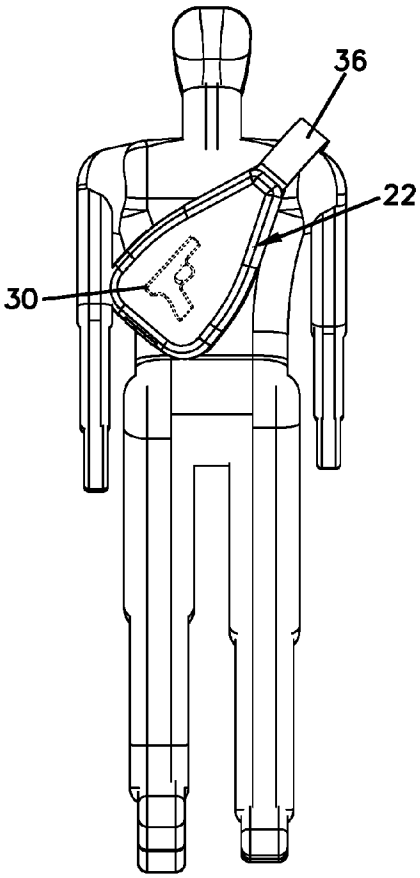
FIG. 10A is a back view showing the portable firearm carrier being worn by a right-handed person with the bag of the portable firearm carrier positioned at the person's back, the handgun is mounted within the bag at an orientation suitable to enhance right-handed access when the bag is moved to the person's front.

For a left-handed person, the portable firearm carrier 20 can be worn with the shoulder strap 36 over the person's left shoulder (see FIG. 10B). In such a configuration, the support substrate 50 can be configured to allow the holster 28 to be repositioned so that the orientation of the handgun grip 32 is flipped 180 degrees within the bag so that the butt end of the grip faces at least partially downwardly when the portable firearm carrier 20 is worn with the shoulder strap 36 over the left shoulder.

In the left-handed configuration, to move the bag 22 from the person's back to the person's front, the bag is moved between the person's right arm and the person's body as the bag moves from the person's back to the person's front. Concurrently, the shoulder strap slides across the person's left shoulder. With the bag positioned at the person's front, the burst location 34 of the burst zipper 26 faces toward the left side of the person's body so that the handgun 30 can be readily accessed from the handgun holster 28 by the person's left hand.

From the forgoing detailed description, it will be evident that modifications and variations can be made without departing from the spirit and scope of the present disclosure.

What is claimed is:

1. A portable firearm carrier comprising:

a bag having an interior compartment, the bag including a burst zipper for accessing the interior compartment of the bag, the burst zipper defining a burst region; and a handgun holster mounted within the interior compartment of the bag, the handgun holster being arranged and configured to retain a handgun at a position where the handgun can be accessed through the burst zipper at the burst region;

a handle attached to the bag for facilitating pulling open the burst zipper, the handle extending across the burst zipper at the burst region to keep the burst zipper closed, the handle configured to conceal at least a section of the burst region of the burst zipper.

2. The portable firearm carrier of claim 1, wherein the bag is a backpack.

3. The portable firearm carrier of claim 2, wherein the backpack includes a single shoulder strap.

4. The portable firearm carrier of claim 1, wherein the burst region is located intermediate the bottom end of the bag.

5. The portable firearm carrier of claim 1, wherein the handgun holster includes a trigger guard mounted holster.

6. The portable firearm carrier of claim 1, wherein the handgun holster is mounted to a support substrate positioned within the interior compartment.

7. The portable firearm carrier of claim 6, wherein the support substrate includes a plate.

8. The portable firearm carrier of claim 7, wherein the plate is a plastic plate.

9. The portable firearm carrier of claim 7, wherein the plate is a ballistic plate.

10. The portable firearm carrier of claim 1, wherein the handle is one of a plurality of handles anchored to the bag on opposite sides of the burst zipper for facilitating pulling open the burst zipper.

11. The portable firearm carrier of claim 10, wherein the handles include straps.

12. The portable firearm carrier of claim 11, wherein at least one of the straps forms a loop.

13. The portable firearm carrier of claim 1, wherein the handle includes a double-loop strap configuration, wherein the double loop strap configuration includes base ends anchored to the bag on a first side of the burst zipper, and wherein a hook and loop fastener arrangement is used to temporarily attach the double loop strap configuration to the bag at a second side of the burst zipper such that the double loop strap configuration extends across the burst zipper and assists in keeping the burst zipper closed until the double loop strap arrangement is manually pulled to disengage the hook and loop fastener arrangement and open the burst zipper.

14. The portable firearm carrier of claim 13, wherein the base ends of the double loop strap configuration are anchored to the bag at a first section of the bag adapted to face away from a person's body when the bag is being carried by the person.

15. The portable firearm carrier of claim 1, wherein the handle is anchored to the bag at a first side of the burst zipper, the portable firearm carrier also including a hook and loop fastener arrangement used to temporarily attach the handle to the bag at a second side of the burst zipper such that the handle extends across the burst zipper and assists in keeping the burst zipper closed until the handle is manually pulled away from the bag to disengage the hook and loop fastener arrangement and open the burst zipper.

16. The portable firearm carrier of claim 15, wherein base ends of the handle are anchored to the bag at a first section of the bag adapted to face away from a person's body when the bag is being carried by the person.

17. A method for using the portable firearm carrier of claim 1, the method comprising:

carrying the bag on a person's back with the shoulder strap positioned over the person's shoulder;

moving the bag from the person's back to a position in front of the person's chest or abdominal region in a motion which causes the shoulder strap to slide across the person's shoulder as the bag moves from the person's back to the position in front of the person's chest or abdominal region; and pulling open the burst zipper to access the handgun.

18. The method of claim 17, wherein an intermediate burst location of the burst zipper faces in a lateral direction when the bag is at the position in front of the person's chest or abdominal region.

19. A portable firearm carrier comprising:

a bag having an interior compartment, the bag including a burst zipper for accessing the interior compartment of the bag;

a handgun holster mounted within the interior compartment of the bag, the handgun holster being arranged and configured to retain a handgun at a position where the handgun can be accessed through the burst zipper; and a double-loop strap configuration, wherein the double loop strap configuration includes base ends anchored to the bag on a first side of the burst zipper, and wherein a hook and loop fastener arrangement is used to temporarily attach the double loop strap configuration to the bag at a second side of the burst zipper such that the double loop strap configuration extends across the burst zipper and assists in keeping the burst zipper closed until the double loop strap arrangement is manually pulled to disengage the hook and loop fastener arrangement and open the burst zipper.

20. The portable firearm carrier of claim 19, wherein the base ends of the double loop strap configuration are anchored to the bag at a first section of the bag adapted to face away from a person's body when the bag is being carried by the person.

21. A portable firearm carrier comprising:

a bag having an interior compartment, the bag including a burst zipper for accessing the interior compartment of the bag;

a handgun holster mounted within the interior compartment of the bag, the handgun holster being arranged and configured to retain a handgun at a position where the handgun can be accessed through the burst zipper; and a handle for facilitating pulling open the burst zipper, the handle being anchored to the bag at a first side of the burst zipper, the portable firearm carrier also including a hook and loop fastener arrangement used to temporarily attach the handle to the bag at a second side of the burst zipper such that the handle extends across the burst zipper and assists in keeping the burst zipper closed until the handle is manually pulled away from the bag to disengage the hook and loop fastener arrangement and open the burst zipper.

22. The portable firearm carrier of claim 21, wherein the base ends of the handle are anchored to the bag at a first section of the bag adapted to face away from a person's body when the bag is being carried by the person.

23. A portable firearm carrier comprising:

a backpack having an interior compartment, the backpack including a burst zipper for accessing the interior compartment of the backpack, the backpack having a top end and a bottom end, the backpack also including a shoulder strap attached to the top end of the backpack, the burst zipper extending across the bottom end of the backpack, the burst zipper having a burst region located at an intermediate location along the bottom end of the backpack; and a handgun holster mounted within the interior compartment of the backpack, the handgun holster being arranged and configured to retain a handgun at a position where the handgun can be accessed through the burst region of the burst zipper.

24. The portable firearm carrier of claim 23, wherein the handgun holster is arranged and configured to retain the handgun at the position so that a back side of a grip of the handgun opposes the burst region of the burst zipper.

25. The portable firearm carrier of claim 23, wherein the backpack is tapered so that the top end is narrower than the bottom end.

* * * * *